US005429288A

United States Patent [19]

Sattler

[11] Patent Number: 5,429,288

[45] Date of Patent: * Jul. 4, 1995

[54] SUPPLEMENTAL CARRY STRAP

[76] Inventor: Warren A. Sattler, 1033 Del Norte Ave., Menlo Park, Calif. 94025

[ * ] Notice: The portion of the term of this patent subsequent to Dec. 14, 2010 has been disclaimed.

[21] Appl. No.: 128,822

[22] Filed: Sep. 28, 1993

Related U.S. Application Data

[63] Continuation-in-part of Ser. No. 807,295, Dec. 12, 1991, Pat. No. 5,269,449.

[30] Foreign Application Priority Data

Dec. 11, 1992 [WO] WIPO ..... PCT/US92/10747

[51] Int. Cl.[6] ..... A45F 3/14

[52] U.S. Cl. ..... 224/258; 224/257; 224/264; 224/205

[58] Field of Search ..... 224/157, 158, 184, 192, 224/203, 205, 206, 209–214, 257, 258, 262, 264; 206/315.1, 315.3, 315.7; 150/107, 108, 110; 383/67; 294/149, 150, 156; 116/200

[56] References Cited

U.S. PATENT DOCUMENTS

| | | | |
|---|---|---|---|
| 4,953,768 | 9/1990 | Muse | 224/205 |
| 5,042,703 | 8/1991 | Izzo | 224/209 |
| 5,246,154 | 9/1993 | Adams et al. | 224/257 |

FOREIGN PATENT DOCUMENTS

| | | | |
|---|---|---|---|
| 9209551 | 7/1991 | WIPO | 224/258 |

*Primary Examiner*—J. Casimer Jacyna

*Attorney, Agent, or Firm*—LaRiviere, Grubman & Payne

[57] ABSTRACT

A supplemental carry strap (100) for use with luggage, including golf bags, garment bags and the like, having a single shoulder carry strap including a padded or unpadded shoulder-contacting element having an optional positioning indicator (18) and two connecting straps (40 and 42) to adjust the position of the carried luggage while retaining the shoulder element in the proper position for contacting the shoulder, and a coupling element (50) for receiving the connecting straps and, further, having a connecting arrangement for attaching the supplemental carry strap to the luggage to be carried.

20 Claims, 14 Drawing Sheets

SUPPLEMENTAL CARRY STRAP

This is a continuation-in-part of application Ser. No. 07/807,295 filed Dec. 12, 1991, now U.S. Pat. No. 5,269,449.

TECHNICAL FIELD

The present invention relates generally to the manual lifting and movement of containers of moderate size and weight and more specifically to carrying straps for golf bags and other luggage having single shoulder straps and a handle.

BACKGROUND ART

Golf is a game that requires a player to transport a substantial amount of equipment as he or she plays the course. Many options are available to the player to accomplish this transportation, such as riding carts, the hand-pulled cart, the powered golf bag can, and the hiring of a caddy to carry the equipment bag. The preferred option, however, for maximum exercise benefit from the game, is for the player to carry his or her own equipment-laden golf bag as he or she walks the course.

While carrying one's own golf bag is the preferred method, the physical strain from doing so may prove detrimental to the golfer's ability to perform as the game proceeds. Carrying a heavy bag over the irregular terrain of a golf course results in increasing fatigue as the game proceeds. Concern over the strain and fatigue caused by carrying one's bag for the duration of the game often leads a player to decide to select an alternative means of transporting the bag, thereby reducing the exercise benefits from the game.

In order to reduce the strain on the player from transporting the bag, golf bags and equipment have been progressively constructed of lighter materials. The typical golf bag is equipped with a single handle and usually a shoulder strap to facilitate lifting and carrying the bag. It is usual in the art to pad the carrying strap so as to lessen the contact stress on the shoulder from the weight of the bag and its contents. Nonetheless, the weight of the typical equipment-laden bag remains substantial and the strain of carrying it remains appreciable.

Observation of a player carrying a golf bag reveals that the stress from carrying the bag is asymmetrically distributed over the upper pan of the player's body by the single shoulder strap with which the bag is carried. In use, the player uses the handle to lift the bag, then positions the single shoulder strap over one shoulder in order to carry the bag. This places the weight of the load on one side of the player's body and the player must adjust his or her stance by leaning to the opposite side in order to balance the load. As the game proceeds, the player will typically alternate the carry from one shoulder to the other in order to alleviate the strain and resultant muscle fatigue which develops from carrying the asymmetrical load. It is this strain and resultant fatigue that affects the golfer's performance.

One approach to distributing the load of the golf bag more symmetrically is to utilize a back pack-like, two strap suspension. This method is utilized by the IZZO System, a carrying strap marketed by IZZO Systems, Inc., P.O. Box 1434, Evergreen, Colo. 80439.

In use, the IZZO System (Izzo) replaces the single shoulder strap supplied with the golf bag. The original strap is removed, by cutting if necessary, and the Izzo is attached in its place. The Izzo system suspends the golf bag from two shoulder straps which are connected to the golf bag in three places; the two outer connections at the points where the original shoulder strap was connected, and the intermediate strap being connected to the handle of the bag. The Izzo strap must remain on the bag once the present owner replaces it. Thus, the Izzo strap cannot be readily transferred to another bag without leaving the first bag without a shoulder strap.

The Izzo strap is fitted to groups of individuals, coming in small, medium and large sizes. This provides the original purchaser with the correct fit but does not allow the original purchaser to transfer the strap to a user who requires a different size.

A further disadvantage of the Izzo strap is that it is designed to orient the bag so that the open end of the golf bag is always on one particular side of the golfer. This is accomplished by the use of dissimilar shoulder pads. One pad is intended to be use on one shoulder and the other pad on the other shoulder. These pads cannot be interchanged. Therefore, the bag is always carried in the same manner and the user does not have the choice of which side of the user's body the open end of the golf bag appears.

DISCLOSURE OF INVENTION

The present invention is a supplemental carrying strap, generally described as an adjustable loop sling, consisting of an adjustable loop of material having a portion for contacting the user's shoulder and two straps for adjusting the size of the loop to accommodate both smaller and larger users. The strap is detachably attached to the handle of the golf bag at or near the center of gravity thereof without any permanent alteration to the bag. The supplemental strap supports some of the weight of the bag on the shoulder opposite the shoulder on which the shoulder strap supplied with the bag is positioned. Thus, the supplemental strap of the present invention balances the weight of the bag symmetrically on the body, thereby reducing the strain which arises from accommodating an asymmetrical load.

The present invention is formed of three cooperating elements. A shoulder element which may or may not be padded distributes the weight of the carried load comfortably on the shoulder; a coupling strap or webbing element which allows the supplemental carrying strap of the present invention to be adjusted to accommodate any size user; and a coupling element which provides coupling of the supplemental strap to the handle of the golf bag, or to the handle of any other piece of luggage which also has a shoulder strap.

The shoulder element is preferably padded and is curved to conform to the slightly sloping aspect of the user's shoulder. The shoulder element also contains an optional placement indicator, such as a material section of contrasting color or texture, so that the user can readily determine which way to grasp the element when positioning the supplemental strap of the present invention onto his or her shoulder.

The padded shoulder element attaches to the second element, strap-like webbing of suitable length disposed at either end of the shoulder element. The webbing portions of the shoulder element include suitable adjustment devices, such as friction buckles, which allow the user to lengthen or shorten the distance between the shoulder element and the coupling element. The two webbing portions, both adjustably attached to the coupling element, allow the distance between the shoulder element and the coupling element to be adjusted while retaining the optimum position of the shoulder element for contacting the user's shoulder.

The third element, herein called a coupling element, comprises a curved rigid material of generally arcuate shape with apertures at either end, one each for receiving one end of the adjustable webbing portion of the shoulder element. The rigid component positions the ends of the adjustable webbing apart so as to provide a naturally open configuration so that the supplemental strap may be conveniently put on the user's shoulder. The coupling element also serves to distribute some of the contact forces from the laden bag comfortably across the user's body.

A third aperture in the coupling element, disposed midway between the first two apertures, receives the coupling means for attaching the coupling element to the handle of the bag to be carried. If the bag is a golf bag, it may have an auxiliary attachment ring near the handle and the user may select either this ring or the handle for attaching the coupling strap. The preferred choice is an attachment point which is closest to the center of gravity of the laden bag. If the bag is luggage, such as a garment or duffle bag, the supplemental strap is typically connected to the luggage handle or to an attaching ring or loop if one is provided by the luggage manufacturer.

The coupling means may be a swivel hook that is snapped into the third aperture in the coupling element and is linked to a section of hook and loop type strap material that is secured around the handle of the golf bag. An alternative coupling means is a coupling strap made of flexible webbing material having its ends secured together with a friction buckle or other fastener. The flexible webbing material accommodates use of the supplemental carry strap of the present invention with different models of golf bags, luggage and by both shorter and taller users of different shapes and sizes. Thus, a single model of the present invention may be used with any bag and by any user.

In use, the single carry strap which is typically supplied with a golf bag and some types of luggage, is placed over whichever shoulder the user prefers and the supplemental strap of the present invention is placed over the user's other shoulder. The two straps distribute the weight of the bag and its contents evenly onto the shoulders of the user. With the weight symmetrically supported on the body the fatigue associated with asymmetrical strain is eliminated.

BRIEF DESCRIPTION OF DRAWINGS

For fuller understanding of the present invention, reference is made to the accompanying drawing in the following detailed Description of the Preferred Embodiment of the invention. In the drawing.

Figure 1:
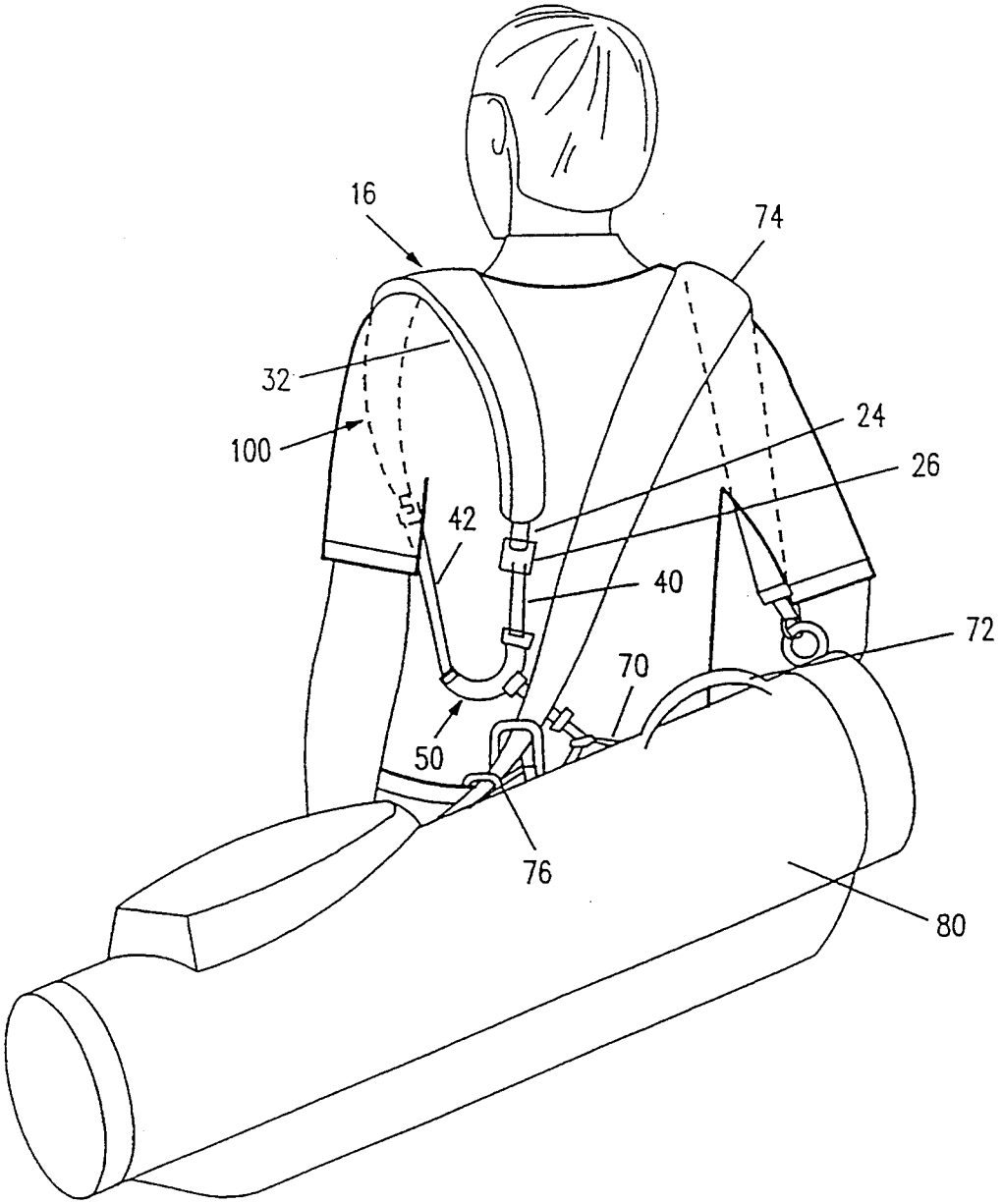
FIG. 1 is a perspective view of the present invention in use for carrying a golf bag.

Reference numbers refer to the same or equivalent parts of the present invention throughout the several figures of the drawing.

BEST MODE FOR CARRYING OUT THE INVENTION

Figure 2:
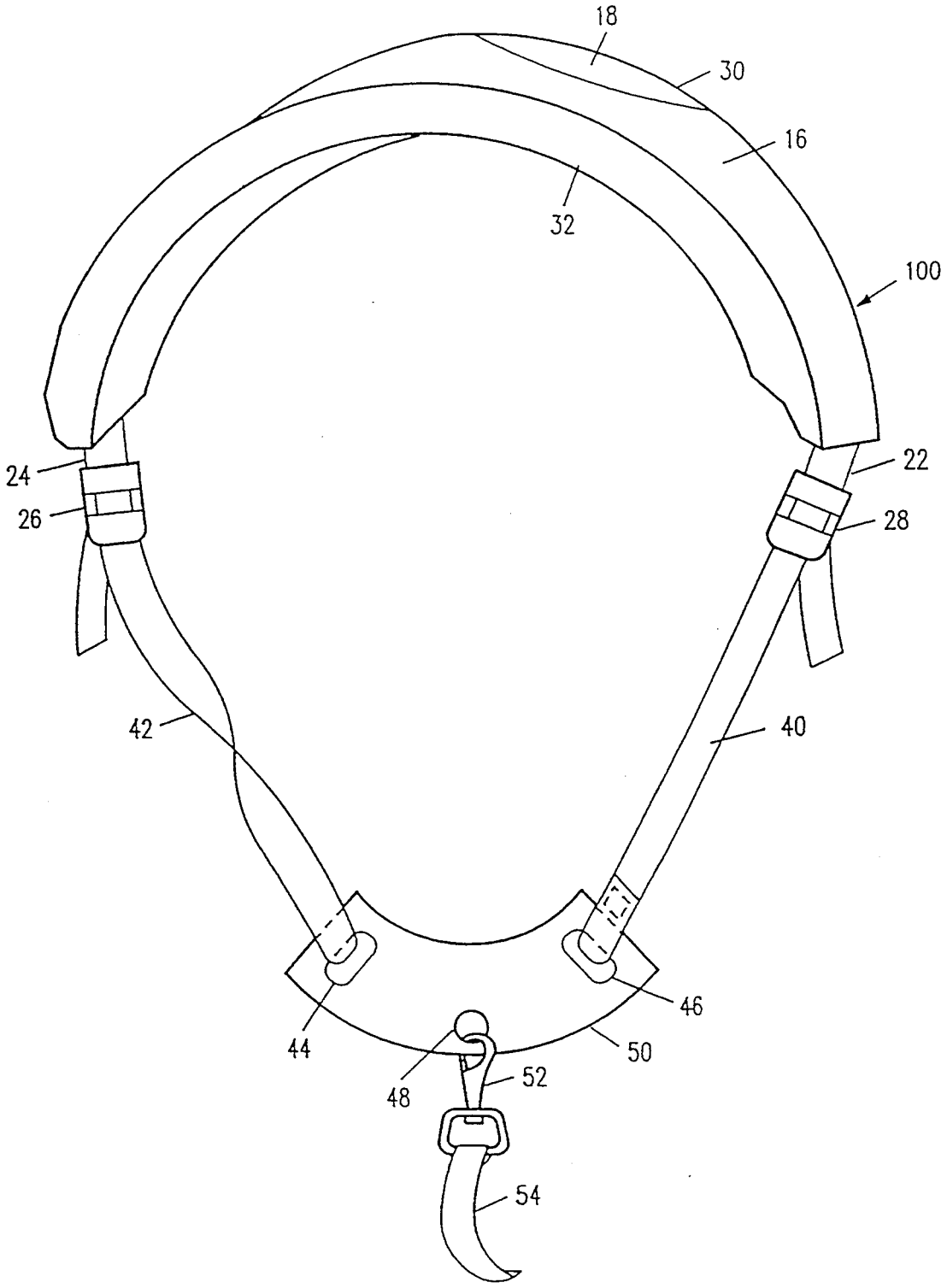
FIG. 2 is a perspective view of the present invention.

Referring now to FIGS. 1 and 2, the present invention is shown. Supplemental carry strap 100 comprises shoulder element 16 having adjustable strap portions 40 and 42, coupling element 50 and swivel hook 52. The adjustable connections between elements of the present invention described hereinbelow are preferably by use of buckles such as the Ladderloc style but other adjustable connection means such as a hook and loop type fastener material, such as the one sold under the trade name of Velcro may also be used.

Strap 100 is attached to golf bag 80 by swivel hook 52 which may be attached by a piece of hook and loop type strap 54 either to the handle of bag 80 or to an attachment ring if one is provided. The choice of attachment point is governed by which point of attachment is closest to the center of gravity of bag 80 when it is filled with equipment.

FIG. 2 shows the assembled strap 100. Shoulder element 16, having adjustable strap portions 40 and 42, is formed of padded or unpadded material and is of arcuate shape with outer convex portion 30 and inner concave portion 32. An optional placement indicator 18 marks the optimum placement for element 16 on the user's shoulder.

Coupling element 50 is formed of thin rigid material such as light weight metal or plastic material. Typical materials may be metal alloys such as aluminum or magnesium or polymeric or plastic materials such as polyvinyl chloride, polypropylene, or Nylon. Coupling element 50 is of generally arcuate shape so that apertures 44, 46 and 48 therethrough are disposed in a triangular pattern. In some applications coupling element 50 may be linear rather than arcuate and apertures 44, 46 and 48 may be disposed in a linear configuration. Alternatively, apertures 44, 46 and 48 may represent points of connection for connecting elements 40 and 42 in lieu of apertures. Other shaped configurations such as triangular may be selected for aesthetic reasons.

Coupling element 50 is also curved in the dimension perpendicular to the planar surface of coupling element 50 so as to conform to the body of the user at the point of contact. This curvature tends to maximize the body contact surface at this point and to reduce the contact pressure on the user's body from the weight of the bag.

Figure 3:
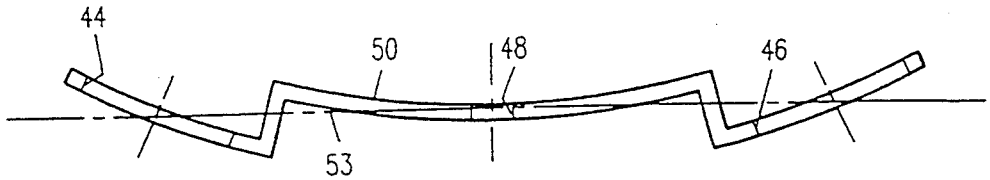
FIG. 3 is an edge view of the connecting element of FIG. 2.
Figure 23:
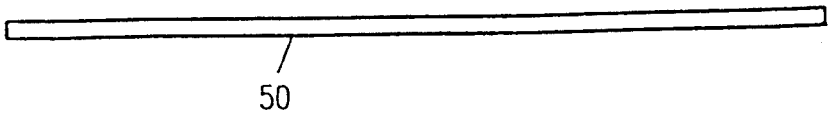
FIG. 23 is an alternate embodiment of FIG. 3.

Referring now to FIG. 3, coupling element 50 is shown in one type of embodiment of an edge view. Other edge views of coupling element 50 can be used in practicing the art as taught by the present invention. By way of example and not limitation, coupling element 50 can be constructed to be substantially planar as shown in FIG. 23. Coupling element 50 can also be curved in the plane perpendicular to connecting elements 40 and 42 so as to conform to the user's body at the point of contact with coupling element 50. It is desirable for concave surface 51 of coupling element 50 to stay flat against the user's body. To accomplish this, the points of attachment represented by apertures 44, 46 and 48 must be disposed in a plane tangent to nadir line 53 of concave surface 51. This transfers the stresses from the weight of the carried bag to adjustable strap portions 40 and 42 as described hereinbelow without generating a rotational moment and displacing concave surface 51 so as to exert point pressure on the user's body.

Referring again to FIGS. 1 and 2, the third aperture 48 in coupling element 50 midway between apertures 44 and 46 receives swivel hook 52 for attaching coupling element 50 to the bag to be carried. If the bag is a golf bag as depicted in FIG. 1, it may have an auxiliary attachment ring 70 near the handle 72 and the user may select either ring 70 or handle 72 for attaching the supplemental carry strap 100. The preferred choice is the attachment point which is closest to the center of gravity of the bag 80 when it is filled with the desired equipment. If the bag is luggage, such as a garment or duffle bag, supplemental carry strap 100 is connected to the luggage handle, or a provided attachment point such as a loop or ring, with swivel hook 52 and a hook and loop type strap 54. A strap 74 supplied with the bag remains in place and is used in the customary manner.

If desired, the swivel hook 52 may be replaced by a coupling strap made of flexible material such as Nylon webbing, or a leather belt, typically one inch in width, which may be threaded through aperture 48 in coupling element 50 and around the handle 72 of the golf bag 80. The swivel hook 52 could also be replaced by a rope-like material such as Nylon cording. The ends of the coupling belt or cord may then be secured together with a buckle or other fastener. The swivel hook 52 may be made in the form of any suitable hook, swivel, snap or other such connecting means which has sufficient capacity to connect to the handle of the bag to be carded and sufficient strength to accommodate the stress of the resultant load.

The swiveling capability of the swivel hook 52 conforms to the angular differences created when the present invention is used with different models of golf bags and luggage by both short and tall users. Affixing the swivel hook 52 at or very near the center of gravity of the bag 80 results in negligible off balance forces to displace the swivel hook 52 from the optimal balance point. Thus, once affixed, the swivel hook 52 remains at the proper point of attachment for optimum balance of the carried load.

Adjustable strap portions 40 and 42 join the coupling element 50 to the shoulder element 16. Strap portions 40 and 42 may be made of any suitable belt-like webbing material such as Nylon, polypropylene or leather typically one inch to one and one-half inches in width, or formed of rolled, circular cross-sectioned, material typically one-half inch to one inch in diameter. One end of strap portion 40 is attached to coupling element 50 by threading the end through aperture 46 and doubling the end back upon and attaching to itself. This attachment preferably may be permanent, as by sewing or adhesively bonding the end to the strap portion 40, or by forming a detachable attachment, as by the use of a buckle or heavy duty hook and loop type material such as Velcro. Strap portion 42 is affixed to coupling element 50 in a similar fashion by threading an end through aperture 44.

Strap portions 40 and 42 also may be adjustably attached to shoulder element 16 by threading through buckles 26 and 28 in a manner well-known in the art. The length of strap portions 40 and 42 is adjusted so as to position coupling element 50 at the nadir or lowest point of the loop formed by supplemental carry strap 100, while disposing shoulder element 16 at the apex with optional placement indicator 18 centered over the user's shoulder. When the supplemental carry strap 100 is first attached to the bag to be carried, it may require an initial adjustment to find the optimum length for strap portions 40 and 42 so that coupling element 50 and shoulder element 16 are correctly placed. If a different user wishes to use the supplemental carry strap 100, readjustment according to the above described procedure is required. Both small and large users may be accommodated.

Figure 4:
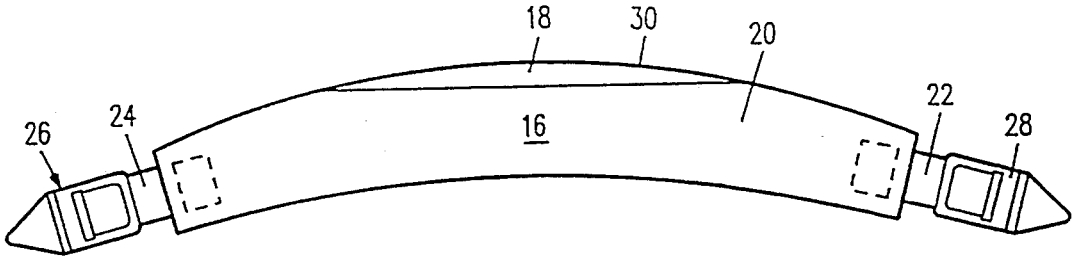
FIG. 4 is a plan view of the shoulder element of the present invention.

Referring now to FIG. 4, the shoulder element 16 is shown. The shoulder element 16 is generally arcuate in shape and is provided with a convex edge 30 and a concave edge 32. The shoulder element 16 may be constructed of either flat, unpadded materials or thick padded member 20 with straps 22 and 24 affixed to the ends thereof, or with straps 22 and 24 being the ends of a continuous length of webbing or strap material with or without padded member 20 placed around the continuous strap 22-24. In the former embodiment, the padded member 20 may be formed of two layers, one of closed cell foam one half inch thick and the other of open cell foam, also one half inch thick and straps 22 and 24 attached thereto as described hereinbelow. Other forms of padding such as sponge rubber or cotton wadding may be used or its use eliminated altogether without deviating from the intent of the present invention.

The closed cell foam layer is encased in a covering of leather, fabric or other sturdy material which in combination with the padding material accommodates the stresses of the weight of the bag. The open celled foam layer is placed on the lower surface of the shoulder element 16 and contacts the user's shoulder, forming a soft padded surface.

The closed cell foam layer one half inch thick may be formed into a sandwich by encasing it with a special outer layer on each side. Nylon back-pack fabric is made with a thin foam layer attached to it. The thin foam layer is about 1/16 to ⅛ inch thick. Using this padded Nylon back-pack fabric to enclose a structural piece of one-half inch closed cell foam for the padded shoulder element 16 has been found to work very well. The sandwich is formed by a first outer layer of Nylon backpack fabric, the thin foam layer attached thereto, the structural piece of one half inch closed cell foam, another thin foam layer and the second outer layer of Nylon back-pack fabric to which it is attached.

The covering material of the shoulder element 16 is fashioned in an arcuate shape. Short straps 22 and 24 are permanently affixed thereto as by sewing at either end of the shoulder element 16 and receive buckles 26 and 28 in a manner well known in the art. Buckles 26 and 28 are suitably sized to accommodate adjustable strap portions 40 and 42. Straps 22, 24, and strap portions 40 and 42 are preferably made of materials similar to the covering material of the shoulder element 16 for aesthetic reasons. As indicated earlier in this specification, straps 22 and 24 may be continuous, through the shoulder element 16, omitting buckles 26 and 28, and homogeneous with strap portions 40 and 42.

Optional placement indicator 18 comprises a material of distinctive color or texture, compatible with but differing from the material covering the shoulder element 16 and affixed to the underside thereof. The optional placement indicator 18 serves to identify the concave portion of shoulder element 16 which should be placed adjacent to the user's neck. The optional placement indicator 18 may be of leather, such as suede or felt, which provides a tactile difference from the remaining surface of the shoulder element 16 so that the user may determine the proper placement without looking.

Figure 4A:
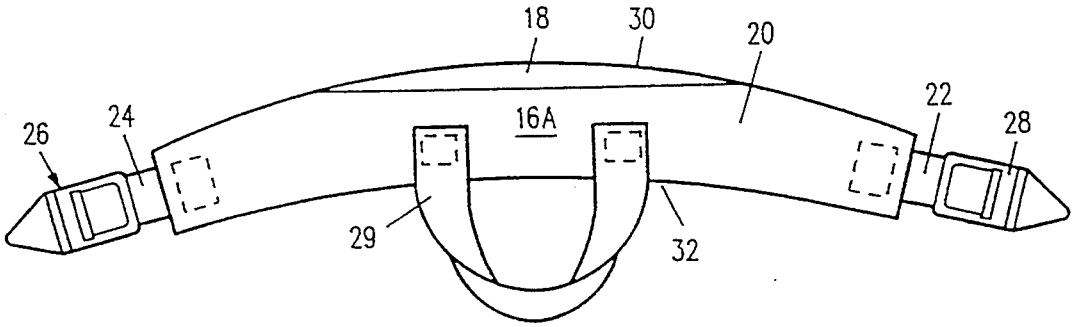
FIG. 4A is a plan view of a second embodiment of the shoulder element of the present invention.

Referring now to FIG. 4A, a second embodiment 16A of shoulder element 16 is shown. Shoulder element 16A includes a grab strap 29. The distal ends of strap 29 are attached approximately three inches apart to the underside of shoulder element 16A. Strap 29 forms a loop that protrudes approximately 1½ inches from the midpoint of concave portion 32.

Figure 5:
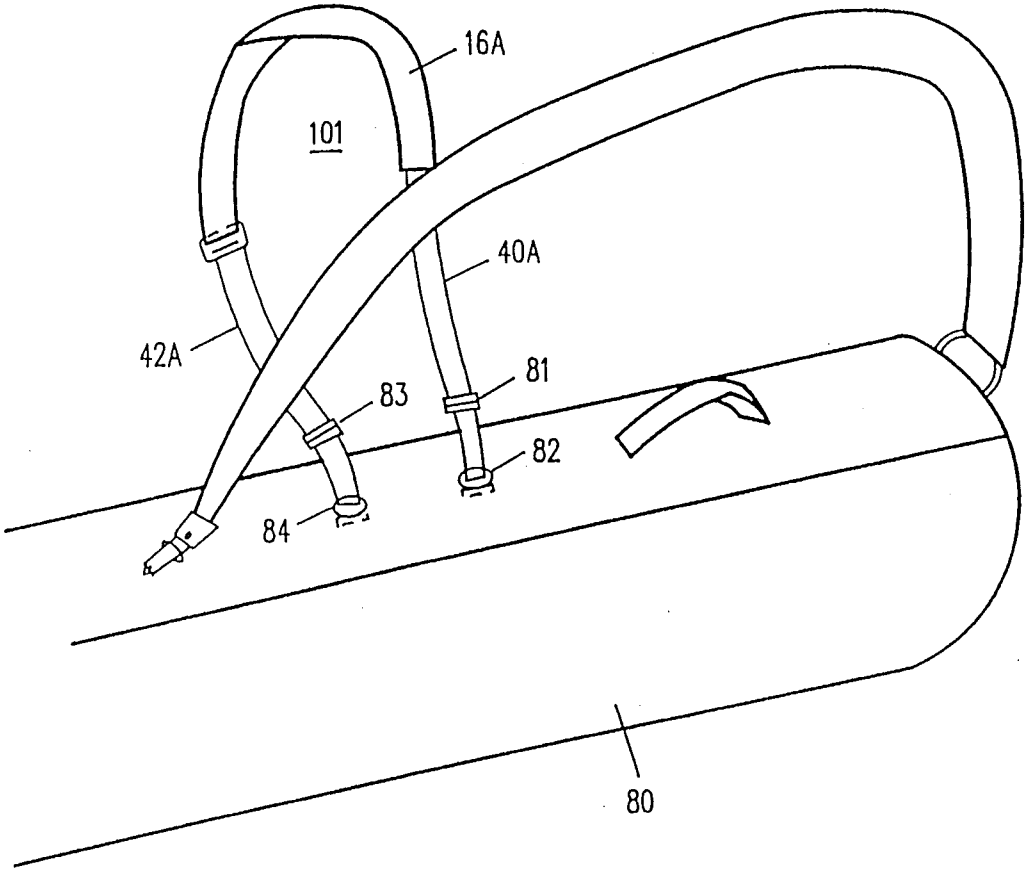
FIG. 5 is a perspective view of a second embodiment of the present invention attached to a golf bag.

Referring now to FIG. 5, a second embodiment 100A of supplemental carry strap 100 is shown. Some models of golf bag 80 may be constructed with two auxiliary attachment rings 82 and 84 proximal to and on opposite sides of the center of gravity of the laden bag 80. Supplemental carry strap 100A is constructed of shoulder element 16A and strap portions 40A and 42A. Shoulder element 16A is similar in most particulars to shoulder element 16 except that strap portions 40A and 42A may be permanently affixed to shoulder element 16A. The distal ends of strap portions 40A and 42A terminate in buckles 81, 83 which fasten the end of each strap to rings 82 and 84. Alternative attaching devices such as swivel hooks and the like as described hereinabove may also be used. The lengths of strap portions 40A and 42A are adjusted at the point of connection to rings 82 and 84 so as to properly place the shoulder element 16A on the user's shoulder.

Figure 6A:
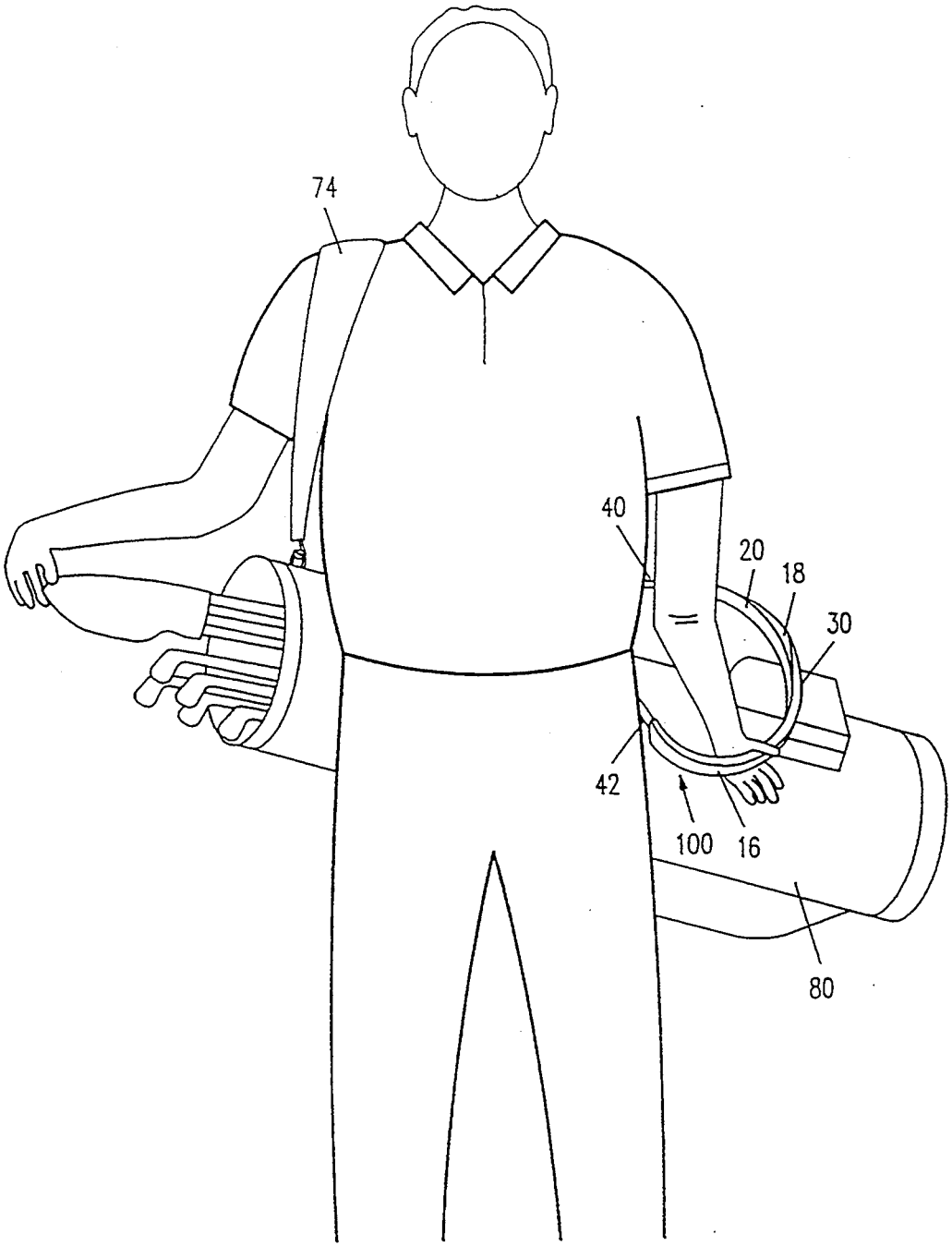
FIGS. 6A–B shows the procedure for donning the present invention.
Figure 6B:
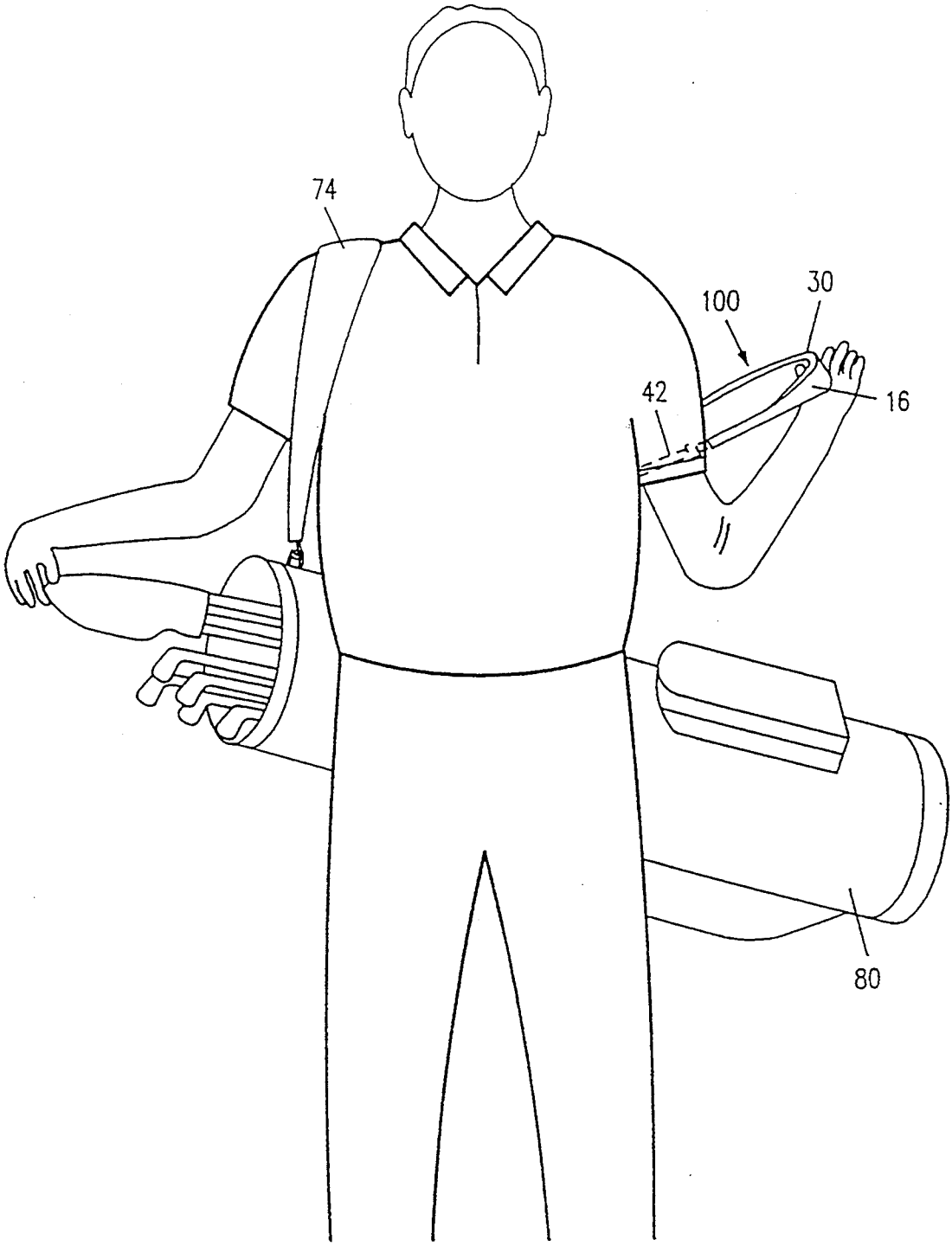

Referring now to FIGS. 6A and 6B, the use of the golf bag 80 equipped with the supplemental carry strap 100 (or 100A) is shown. The user first picks up the laden bag 80 and places the supplied carry strap 74 over one shoulder in the conventional manner. The choice of shoulder does not affect the use of supplemental carry strap 100. The bag will rest in contact against the side of the user's lower back beneath the shoulder supporting strap 74. The open end of the bag 80 faces forward and slightly to the side away from the user. If the user wishes to stop at this point, the bag 80 may be carried in the conventional manner.

The user then reaches down with the hand opposite the side supporting the bag 80 and grasps the shoulder element 16 at the placement indicator 18 by reaching through the loop formed by the supplement carry strap 100. In this manner, his thumb will rest on the bottom side of the shoulder element 16 with the convex edge 30 near the tip of his thumb. The optional placement indicator 18 will indicate the correct grasp when it is disposed up away from the bag 80.

Once element 16 is correctly positioned and grasped, the user lifts the supplemental carry strap 100 into place as shown in FIG. 6B. As the supplemental carry strap 100 is lifted, the user's elbow slips in between adjustable strap portions 40 and 42. This maneuver is accomplished without difficulty because strap portions 40 and 42 are held apart by coupling element 50. The user positions the shoulder element 16 on his shoulder and donning is complete. This procedure is illustrated for a left shoulder carry for the supplemental carry strap 100 but is equally applicable to a right shoulder carry. The distance between shoulder element 16 and coupling element 50 may be too short to comfortably accommodate the unusually large user with long arms. For the supplemental carry strap 100 equipped with shoulder element 16A, the user has the option of grasping strap 29 and lifting the supplemental carry strap into place. By grasping strap 29, the users hand is farther from the coupling element 50, thus providing the user with long arms extra distance for the user's elbow to slip over the coupling element 50.

In the carrying position, some of the weight of the bag 80 is transmitted through the swivel hook 52 to the coupling element 50. The triangular disposition of the adjustable strap portions 40 and 42 relative to the swivel hook 52 transmits the weight equally through both straps to the shoulder element 16. This equal distribution of weights holds the shoulder element 16 securely on the user's shoulder without off balance stress. If the coupling element 50 is linear rather than arcuate, attaching points represented by apertures 44, 46 and 48 are evenly disposed along the coupling element 50 with the same result.

Figure 7:
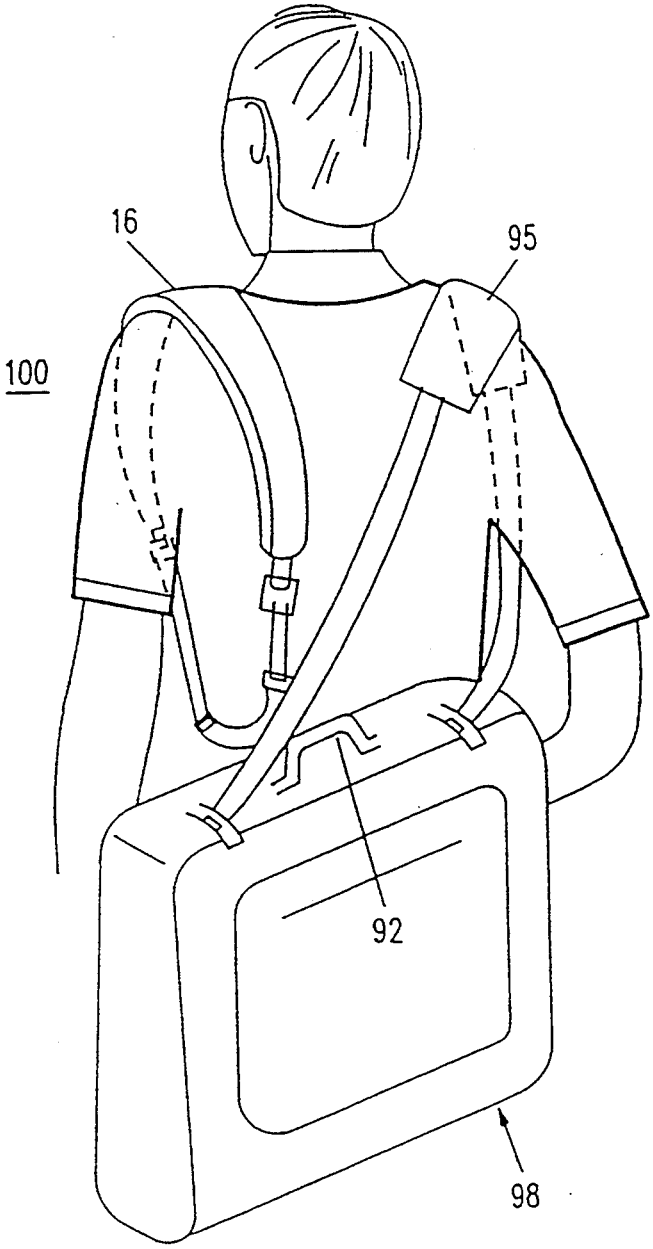
FIG. 7 is a perspective view of the present invention in use for carrying a garment bag.
Figure 8:
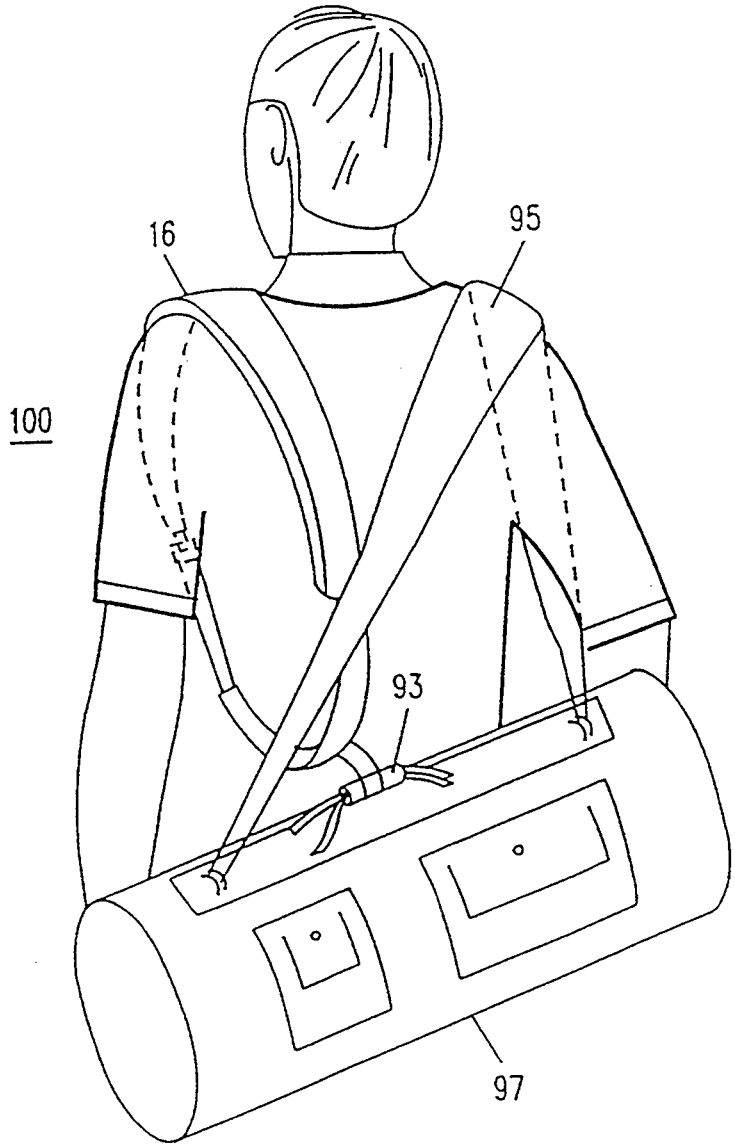
FIG. 8 is a perspective view of the present invention in use for carrying a duffle bag.

Referring now to FIGS. 7 and 8, the use of the supplemental carry strap 100 with luggage is shown. Luggage having a single shoulder strap 95, such as garment bag 98 or duffle bag 97, is often heavy enough to place great strain on the user when it is asymmetrically carried by use of shoulder strap 95 with which the luggage was supplied. This is especially true if the user is of diminutive or slight build. Supplemental carry strap 100 may be attached to handles 92 or 93 and the supplemental carry strap 100 placed over the shoulder opposite the shoulder supporting strap 95, thereby distributing the weight of the laden bag 97, 98 symmetrically on the body. If the user wishes to move the supplemental carry strap 100 from one piece of luggage to another, he may do so by re-attaching the coupling means comprising the swivel hook 52 and the section of hook and loop type strap material 54, or any other alternative coupling webbing or strap (FIGS. 1 and 2) as described hereinabove.

Figure 9:
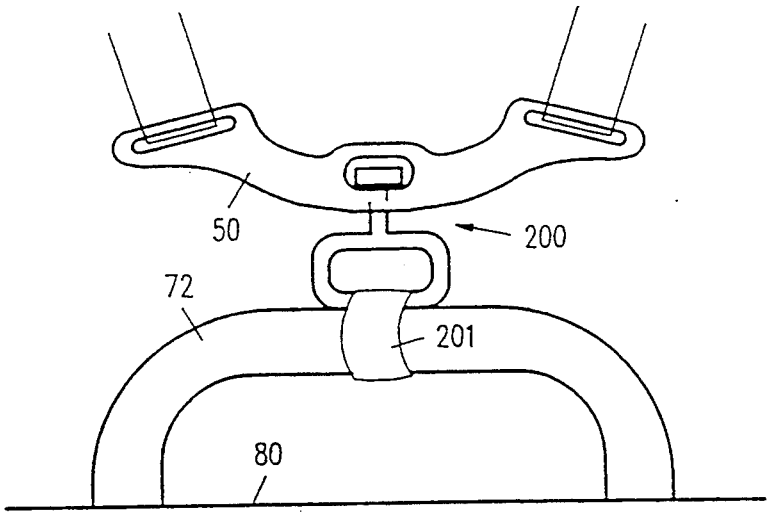
FIG. 9 is a view of a first swiveling arrangement for the supplemental carry strap of the present invention.
Figure 10:
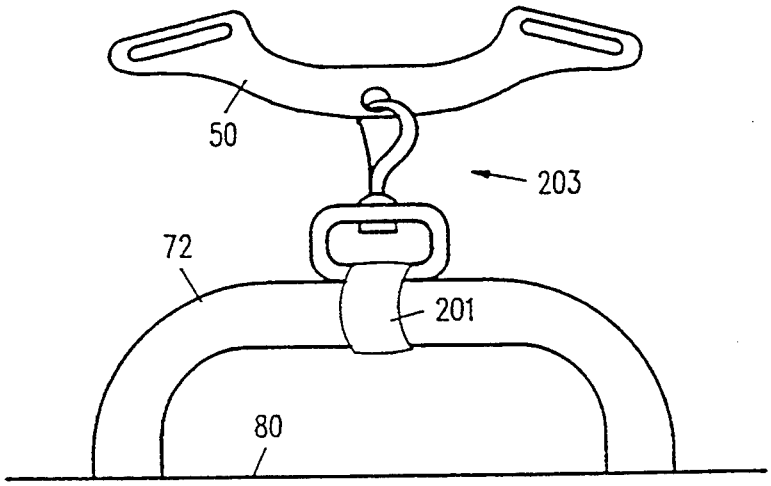
FIG. 10 is a view of a second swiveling arrangement for the supplemental carry strap of the present invention.
Figure 11:
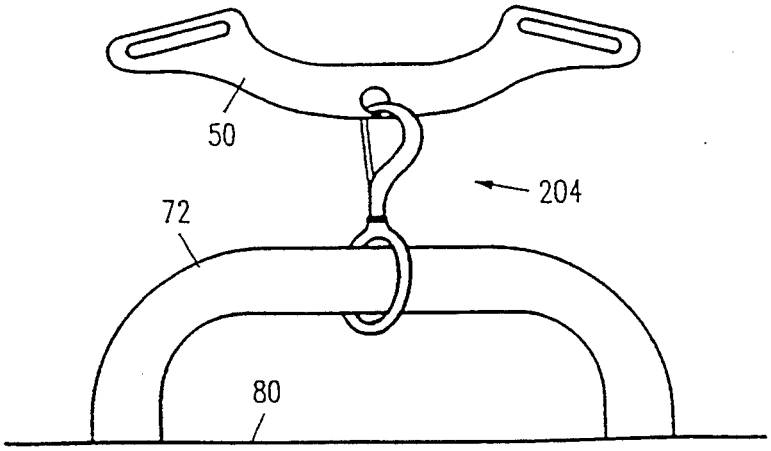
FIG. 11 is a view of a third swiveling arrangement for the supplemental carry strap of the present invention.

Thus, there has been described one exemplary embodiment of a supplemental carry strap 100 in accordance with the principles of the present invention. It will be understood that many variations and modifications may be made without departing from the scope of the present invention. For example, it may be found desirable to provide other coupling arrangements between the coupling element 50 and the bag 80. FIG. 9 shows a swivel connection 200, which may be specially manufactured if desired, connecting the coupling element 50 to the handle 72 of a bag 80 by means of a coupling strap 201 made of a hook and loop type fastener material such as the one sold under the trade name Velcro. FIG. 10 shows another variation in which a swivel hook 203 snaps onto the coupling element 50 and is secured to the handle 72 of the bag 80 with the hook and loop type coupling strap 201. FIG. 11 shows a bag 80 that is manufactured with a swivel hook 204 attached to the handle 72, eliminating the need for the hook and loop type coupling strap 201. These swivel arrangements enable the bag 80 to swivel or rotate 360° unimpeded.

Figure 12:
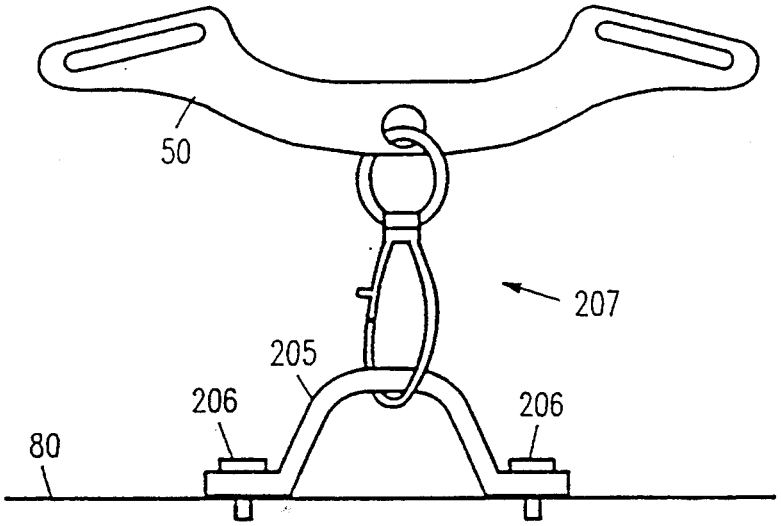
FIG. 12 is a view of a fourth swivelling arrangement for the supplemental carry strap of the present invention.
Figure 13:
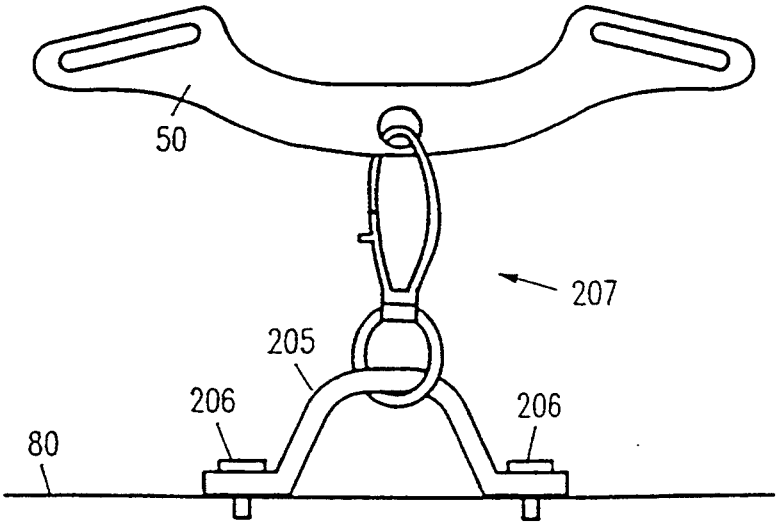
FIG. 13 is a view of a fifth swiveling arrangement for the supplemental carry strap of the prevent invention.

Both golf bags and carry-on luggage, such as garment bags, may be equipped with attachment hardware. FIG. 12 shows a bag 80 equipped with a loop 205 that is secured to the bag 80 by means of fasteners 206 such as rivets, or the like. The coupling element 50 is provided with a swivel hook 207 that snaps onto the loop 205. FIG. 13 shows a similar arrangement, except that the loop 205 is provided with the swivel hook 207, and the swivel hook 207 snaps onto the coupling element 50.

Figure 14:
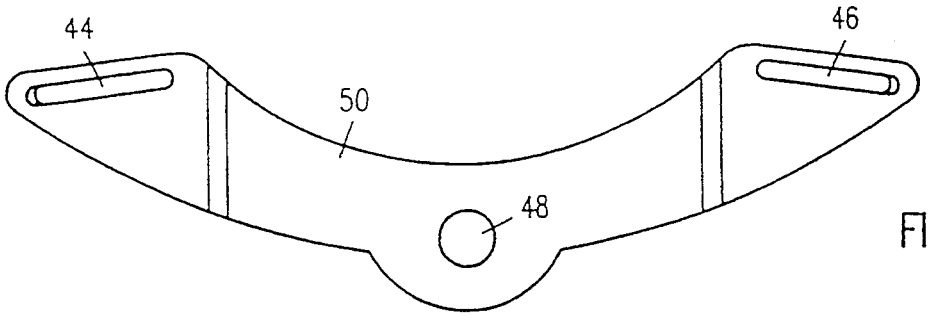
FIG. 14 is plan view of the coupling element shown in edge view in FIG. 3.
Figure 15:
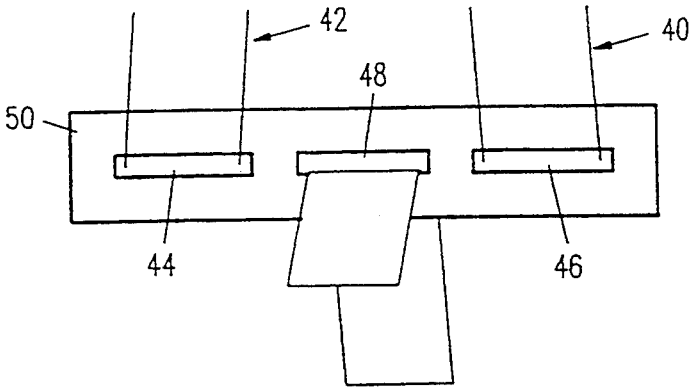
FIG. 15 is a view of a second coupling element for the supplemental carry strap of the present invention.
Figure 16:
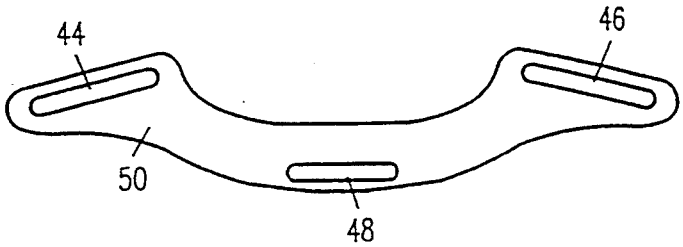
FIG. 16 is a view of a third coupling element for the supplemental carry strap of the present invention.
Figure 17:
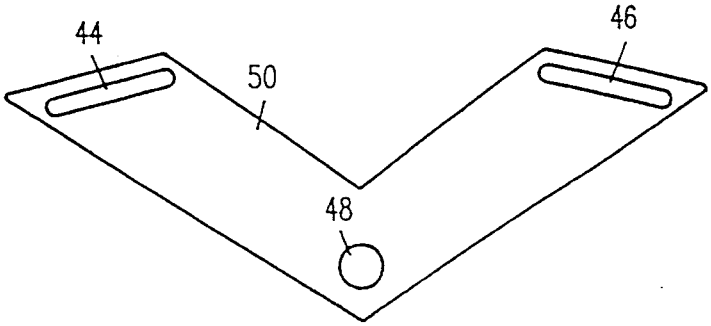
FIG. 17 is a view of a fourth coupling element for the supplemental strap of the present invention.
Figure 18:
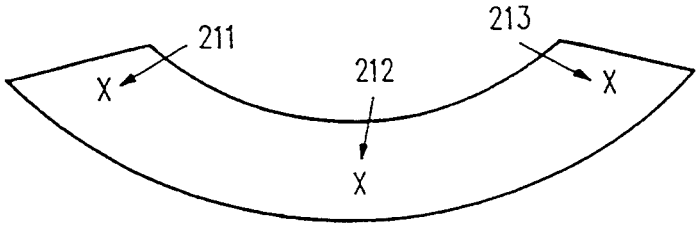
FIG. 18 is a view of a fifth coupling element for the supplemental carry strap of the present invention.
Figure 21:
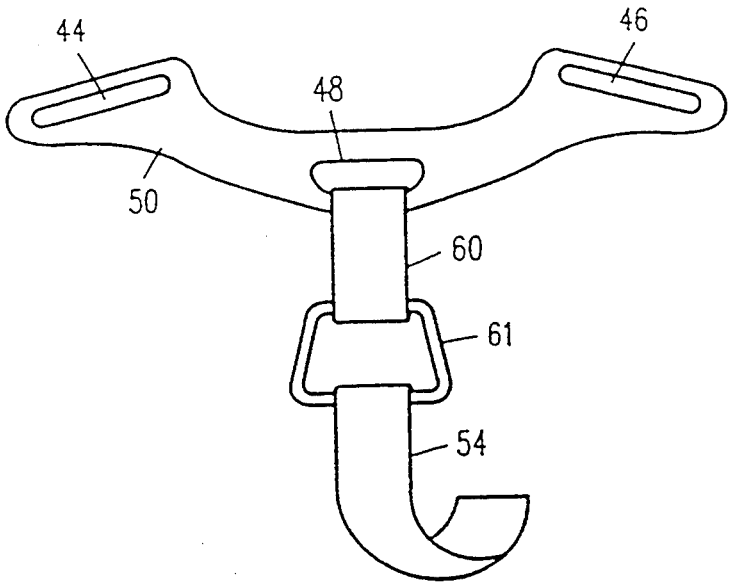
FIG. 21 is an embodiment of the third coupling element of FIG. 16 according to the present invention.
Figure 22:
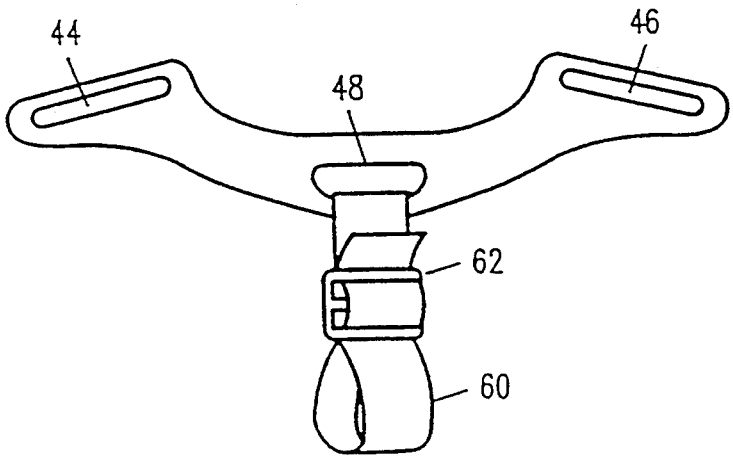
FIG. 22 is an alternate embodiment of FIG. 21.

The coupling element 50 is employed as a spreader, and is not limited to one particular configuration. FIG. 14 shows the coupling element 50 in the configuration that corresponds to the edge on view of FIG. 3. Here, the outer apertures 44, 46 are elongated rectangular slots, while the center aperture 48 is a round hole. FIG. 15 shows a coupling element 50 that is not arcuate and has the apertures 44, 46, 48 in a straight line. Here, all three apertures 44, 46, 48 are elongated rectangular slots. FIG. 16 shows the coupling element 50 having three slot apertures 44, 46, 48 not disposed in a straight line, and having a smoothly contoured outer periphery. FIG. 21 shows coupling element 50 of FIG. 16 having attached to it coupling strap 60, connecting ring 61 and hook and loop type strap 54. FIG. 22 shows coupling element 50 of FIG. 16 having attached to it coupling strap 60 and coupling strap 62 can be any of a variety of buckles well-known in the art of the present invention, including but not limited to buckles made of plaster having an insertion portion which clips into a mating portion. FIG. 17 shows a triangular coupling element 50 having the slotted outer apertures 44, 46 and a circular central aperture 48. FIG. 18 illustrates a coupling element 50 that does not have apertures at all. Instead, the straps are affixed to the coupling element 50 in a permanent manner as by riveting at points 211, 212, 213.

Figure 19:
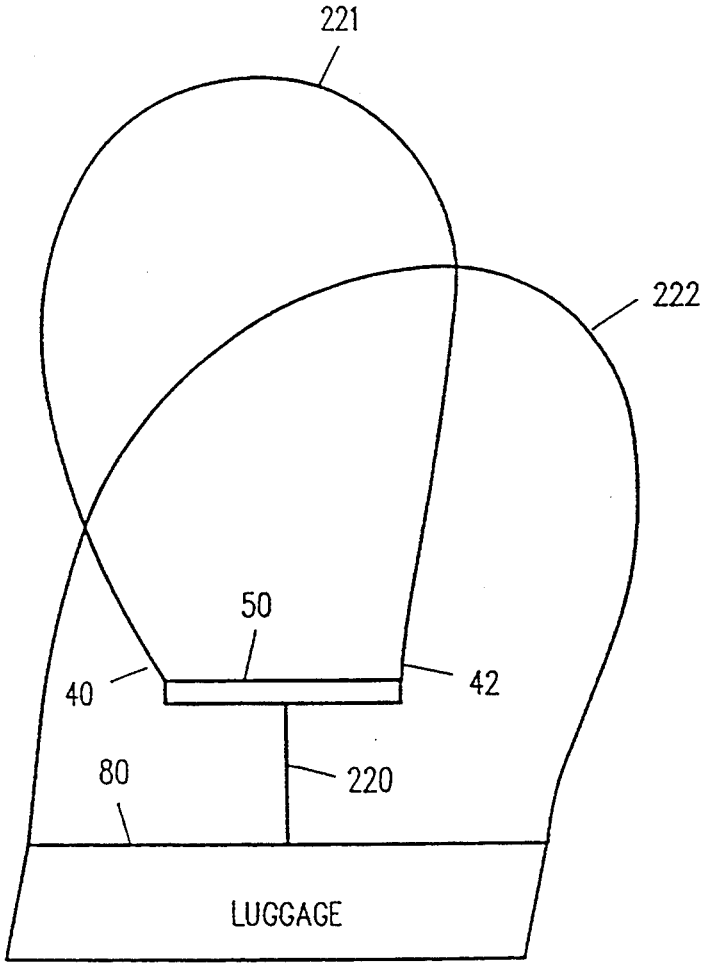
FIG. 19 is a diagrammatic view of the basic configuration of the supplemental carry strap of the present invention.

FIG. 19 shows the host basic configuration of the supplemental carry strap 100. It is provided with a rigid spreader or coupling element 50 having adjustable straps 40, 42 connected to the ends thereof. A single point multirotational connector 220 extends from the center of the coupling element 50 to the bag 80. The supplemental carry strap 100 is provided with an adjustable flaccid shoulder strap 221, while the bag 80 is provided with a single shoulder strap 222.

Figure 20:
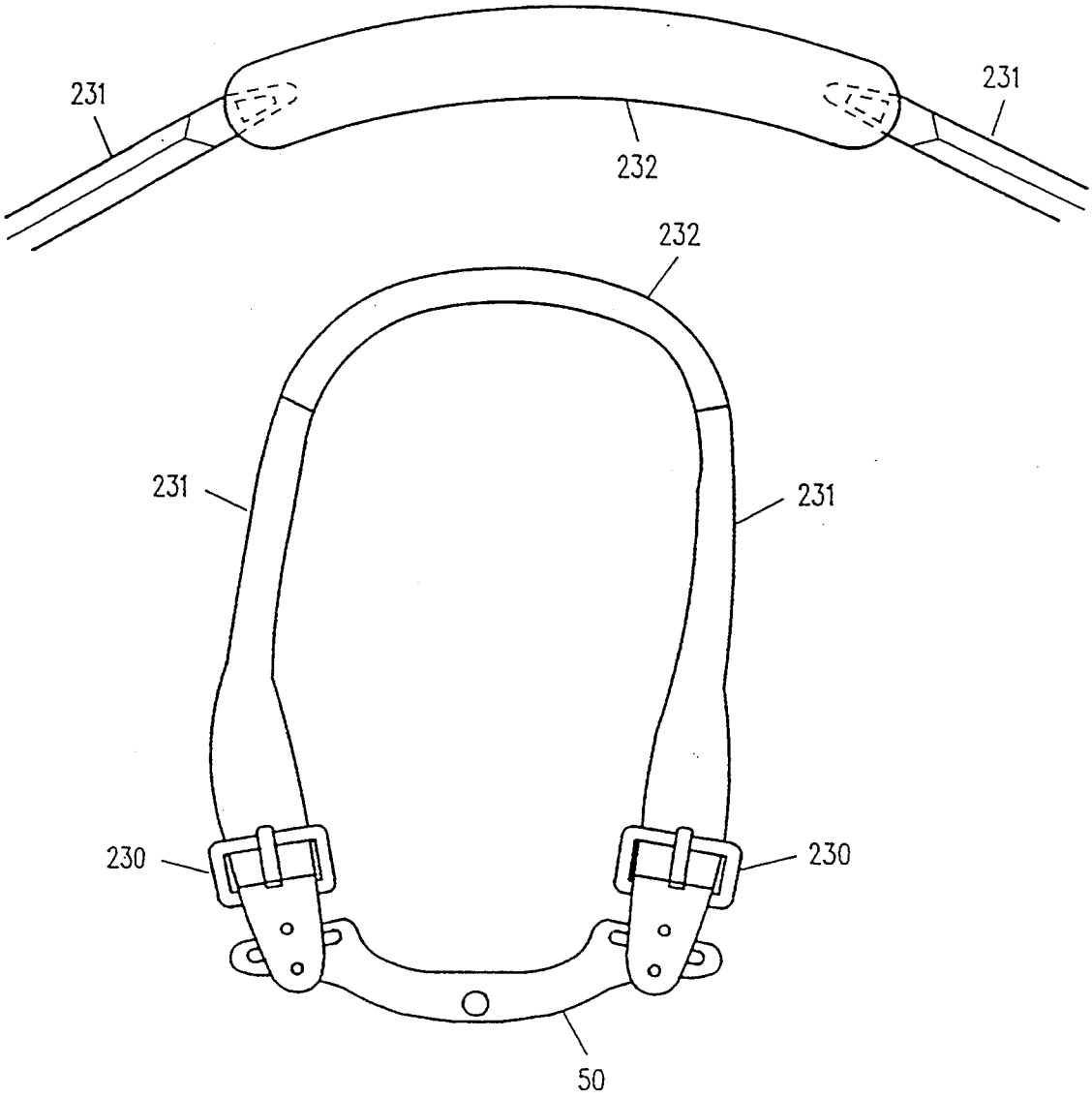
FIG. 20 is a view of a typical embodiment of the supplemental carry strap of the present invention as it may be implemented for fine luggage.

FIG. 20 shows a typical embodiment of the supplemental carry strap 100 as provided for fine luggage. The supplemental carry strap 100 is provided with a polished metal spreader or coupling element 50, sturdy belt buckles 230, rolled leather adjustable straps 231, and a leather shoulder element 232 that may or may not be padded, as desired.

The present invention has been particularly shown and described with respect to certain preferred embodiments thereof. However, it should be readily apparent to those of ordinary skill in the art that various changes and modifications in form and details may be made without departing from the spirit and scope of the invention as set forth in the appended claims.

I claim:

1. A carrying strap for a piece of luggage having a handle, the carrying strap comprising:

a shoulder element;

a coupling element having three apertures therethrough and a middle region, a first and a second aperture disposed apart and each being at opposite ends of said coupling element for receiving a first and a second strap and a third aperture proximal to the middle region of said coupling element and disposed midway between said first and said second aperture for receiving a coupling means;

said first and said second strap for adjustably connecting said shoulder element to said coupling element; and said coupling means for removably attaching said coupling element to said luggage.

2. A carrying strap as in claim 1 wherein said shoulder element is comprised of a material having a portion thereof distinguished by a different color, said distinguished portion disposed so as to mark a specific position on said shoulder element.

3. A carrying strap as in claim 1 wherein said shoulder element is comprised of a material having a portion thereof distinguished by a different texture, said distinguished portion disposed so as to mark a specific position on said shoulder element.

4. A carrying strap as in claim 1 wherein said shoulder element is padded.

5. A carrying strap as in claim 1 wherein said coupling element is composed of rigid material.

6. A carrying strap as in claim 5 wherein said coupling element is composed of metal.

7. A carrying strap as in claim 5 wherein said coupling element is composed of polymeric material.

8. A carrying strap as in claim 1 wherein said coupling means is a third strap having a proximal and a distal end, the proximal end terminated with a buckle and the distal end configured in a compatible manner for use with said buckle so as to allow said ends of said third strap to be detachably fastened into a loop.

9. A carrying strap as in claim 1 wherein said coupling means is a third strap having a proximal and a distal end, the proximal end affixed to said coupling element and the distal end terminated with a snap swivel so as to allow said distal end of said third strap to be detachably fastened to said piece of luggage.

10. A carrying strap as in claim 1 wherein said coupling means is a snap swivel having a proximal and a distal end, the proximal end affixed to said coupling element and the distal end terminated in said snap so as to allow said coupling element to be detachably fastened to said piece of luggage.

11. A carrying strap as in claim 1 wherein said first and second adjusting straps are terminated in a buckle at one end and fixedly attached to said coupling element at an end opposite said one end.

12. A carrying strap as in claim 1 wherein said coupling means is a coupling strap having a coupling ring.

13. A carrying strap as in claim 1 wherein said coupling means is a coupling strap having a buckle.

14. A carrying strap for a piece of luggage having carrying means for carrying the luggage attached thereto, the carrying strap comprising:

a shoulder element:

a coupling element;

a first and a second strap for adjustably connecting the shoulder element to the coupling element; and coupling means for removably attaching the coupling element to the luggage;

the coupling element having at least three apertures therethrough, a first aperture at one end of the coupling element, a second aperture at an end opposite the one end of the coupling element, the first and the second aperture defining a middle region therebetween, a third aperture located in the middle region;

the first aperture for receiving the first strap;

the second aperture for receiving the second strap;

the third aperture for receiving the coupling means.

15. A carrying strap as in claim 14 wherein the shoulder element is padded.

16. A carrying strap as in claim 15 wherein the coupling element is made of a rigid material.

17. A carrying strap as in claim 16 wherein the coupling means includes a third strap, the third strap for removably attaching the luggage to the coupling means.

18. A carrying strap as in claim 17 wherein the third strap is made of a hook and loop type fastener material.

19. A carrying strap as in claim 16 wherein the coupling element is of an arcuate shape.

20. A carrying strap as in claim 19 wherein the first and the second strap each include friction buckles for adjustably connecting the shoulder element.

* * * * *